US006496679B2

(12) United States Patent
Kitahara

(10) Patent No.: US 6,496,679 B2
(45) Date of Patent: Dec. 17, 2002

(54) PIVOTALLY MOVABLE ABUTMENT MECHANISM, CHARGING DEVICE AND IMAGE FORMING APPARATUS

(75) Inventor: Makoto Kitahara, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/863,252

(22) Filed: May 24, 2001

(65) Prior Publication Data

US 2002/0006295 A1 Jan. 17, 2002

(30) Foreign Application Priority Data

May 26, 2000 (JP) ..... 2000-155918

(51) Int. Cl.[7] ..... G03G 15/14
(52) U.S. Cl. ..... 399/310; 399/313
(58) Field of Search ..... 399/310, 66, 297, 399/299, 302, 308, 312, 313

(56) References Cited

U.S. PATENT DOCUMENTS 4,627,709 A 12/1986 Kitajima et al. ..... 355/3 SH
4,900,009 A 2/1990 Kitahara et al. ..... 271/296
5,110,104 A 5/1992 Wakao et al. ..... 271/3.1
5,186,454 A 2/1993 Kitahara ..... 271/294
5,937,246 A * 8/1999 Kaneyama ..... 399/228
6,044,244 A * 3/2000 Watanabe et al. ..... 399/313
6,078,777 A * 6/2000 Imumi et al. ..... 399/313
6,253,041 B1 * 6/2001 Tomizawa et al. ..... 399/66

FOREIGN PATENT DOCUMENTS

JP 11-52763 * 2/1999

* cited by examiner

*Primary Examiner*—Quana M. Grainger
(74) *Attorney, Agent, or Firm*—Fitzpatrick, Cella, Harper & Scinto

(57) ABSTRACT

A pivotally movable abutment mechanism is provided, which includes an abutment member for abutting against a member to be abutted over the longitudinal direction, a supporting member that supports the abutment member and is pivotally movable about a pivotal axis, a pressing member for pivotally moving the supporting member in the direction in which the abutment member is pressed against the member to be abutted, and a pivotal axis moving mechanism capable of changing the position of the pivotal axis by a pressing operation by the pressing member.

42 Claims, 10 Drawing Sheets

PIVOTALLY MOVABLE ABUTMENT MECHANISM, CHARGING DEVICE AND IMAGE FORMING APPARATUS

BACKGROUND OF THE INVENTION

1. Field of the Invention

The present invention relates to a pivotally movable abutment mechanism that pivotally moves to abut against an abutted member, and an image forming apparatus such as an electrophotographic copying machine or a printer using the pivotally movable abutment mechanism. In particular, the present invention relates to a mechanism for causing charging means and transferring means to pivotally move to abut and an image formation using the mechanism.

2. Related Background Art

A conventional image forming apparatus will be described with reference to FIG. 12. An image forming apparatus shown in FIG. 12 includes four process units. Latent images are formed on photosensitive drums 101 (101*a*, 101*b*, 101*c* and 101*d*), which are image bearing members, in the respective process units. The formed latent images are developed, and then toner images are superimposed to be transferred on a transfer material on a transfer material bearing member one after another. A full color image is obtained by heating to fix the toner images by a fixing unit (not shown) in the downstream.

Inside an elliptical shape formed by a transfer belt 102 being a transfer material bearing member, a transfer blade unit is provided which includes transfer blades 103 (103*a*, 103*b*, 103*c* and 103*d*) being transfer charging means, which are plate-like contact electrodes, blade holders 104 (104*a*, 104*b*, 104*c* and 104*d*) for supporting the transfer blades 103*a* to 103*d*, and pivoting shafts 105*a*, 105*b*, 105*c* and 105*d* for pivotally supporting the blade holders 104*a* to 104*d*. The transfer belt 102 contacts the photosensitive drums 101*a* to 101*d* being image bearing members, and is supported and biased by the transfer blades 103*a* to 103*d* at each contact point and is applied a transfer voltage.

However, in the above-mentioned conventional example, the pivoting shafts 105 (105*a*, 105*b*, 105*c* and 105*d*) being rotational center shafts of the transfer blades 103 and the blade holders 104 are fixed at their respective predetermined positions. Thus, there is a problem in that a distribution of an abutting pressure of the transfer blades 103 in the longitudinal direction of the photosensitive drums 101 becomes even.

For example, a case will be considered in which both ends of the pivoting shafts 105 are not parallel with axes of the photosensitive drums 101, and rotational centers in the back side of the apparatus are closer to the photosensitive drums 101 than to rotational centers in the front side of the apparatus. In such a case, when the transfer blades 103 rotate about the pivoting shafts 105, the back sides of the transfer blades 103 abut against the transfer belt 102 first. At this point, the contacting portions are in positions deviated to the downstream side of the transfer belt movement from ideal positions (positions the transfer blades 103 should originally abut against the transfer belt 102). In addition, the front sides of the transfer blades 103 have not abutted against the transfer belt 102 yet.

When more pressure is applied to the transfer blades 103, the portions of the transfer blades 103 abutting against the transfer belt 102 start to bent first by the pressurizing power because the transfer blades 103 are formed of a material having flexibility such as a rubber plate member and a brush.

With the abutment portions of the transfer blades 103 bending, non-abutment portions more in front than the abutment portions start to abut against the transfer belt 102. Before long, the back sides of the transfer blades 103 bend significantly, and the pressurizing completes when the portions of the transfer blades 103 on the front sides abut against the transfer belt 102. At this point, an abutment pressure distribution in the longitudinal direction of the abutment portions of the transfer blades 103 and the transfer belt 102 is high in the back side and low in the front side. This is because the pressurizing power by pressurizing means is lost by the bent of the transfer blades 103 and is not sufficiently transmitted to the front side.

The contacting portions of the transfer blades 103 and the transfer belt 102 are in positions more deviated with the transfer blades 103 bending from the positions at the instance of abutment. The higher the abutment pressure is, this tendency gets stronger, the back sides of the transfer blades 103 where the abutment pressure is high bend more, and the positional deviations increase accordingly.

That is, in the case in which the back sides of the pivoting shafts 105 of the transfer blades 103 positionally deviate in the direction to approach the photosensitive drums 101 (upward) and the front sides positionally deviate in the direction to recede from the photosensitive drums 101 (downward), the abutment pressure distribution is high in the back sides. To the contrary, in the case in which the back sides of the pivoting shafts 105 positionally deviate in the direction to recede from the photosensitive drums 101 (downward) and the front sides positionally deviate in the direction to approach the photosensitive drums 101 (upward), the abutment pressure distribution of the transfer blades 103 and the photosensitive drums 101 is high in the front sides.

In addition, in the case in which the pivoting shafts 105 of the transfer blades 103 positionally deviate in the direction to approach the photosensitive drums 101 (upward), the contacting portions of the transfer blades 103 deviate in the downstream side of the moving direction of the transfer belt 102. In the case in which the pivoting shafts 105 positionally deviate in the direction to recede from the photosensitive drums 101 (downward), the contacting portions deviate in the upstream side of the moving direction of the transfer belt 102.

In this way, as the abutment pressure distribution of the transfer blades 103 becomes unequal, the bent amount of the transfer blades 103 also becomes unequal. Thus, the positional deviations of the contacting points of the transfer blades 103 and the transfer belt 102 get larger and increase a deviation amount due to dimensions of parts.

In addition, when the abutment pressure of the transfer blades 103 exceeds a predetermined value, the abutment portions of the photosensitive drums 101, the transfer blades 103 and the transfer belt 102 are abraded more, which shortens lifetimes of these parts.

In addition, when the abutment pressure of the transfer blades 103 gets lower than a predetermined value, normal transfer cannot be performed and an image defect such as a blank area is generated. In particular, this tendency is evident when an image is transferred on a cardboard or an undulated sheet (e.g., a second side in a two-side recording, left paper at high temperature and high humidity, left paper at low temperature and low humidity, or the like). In addition, a positional deviation of the transfer blades 103 exceeding a predetermined amount can be a cause of an image defect.

Here, in order to hold an abutment pressure distribution of the transfer blades 103 within a predetermined amount, it is necessary to extremely accurately manage a rotational central positions of the transfer blades 103, which increases costs for parts. In addition, in some cases, an adjustment process is necessary when an apparatus is assembled, which increases production costs of the apparatus.

Further, this is not limited to an abutment of a transfer blade. It is also very important from a perspective of an equal charging performance and a lifetime to cause a charging member to abut equally, for example, in a charging device that charges a charged member by causing the charging member to abut against the charged member along the longitudinal direction.

In this way, in the case of a configuration for pivotally moving an abutment member to cause it to abut against an abutted member along the longitudinal direction, it is difficult to achieve equal abutment along the longitudinal direction. Thus, high accuracy of parts and complicated adjustment processes are required.

SUMMARY OF THE INVENTION

The present invention has been devised in view of the above problems, and it is an object of the present invention to achieve the equalization of an abutment pressure distribution between an abutment member and a member against which the abutment member abuts (hereinafter referred to as "an abutted member") without using high accuracy of parts and adjustment processes in the case in which the pivoting abutment member is used.

In order to achieve the above-mentioned object, an pivotally movable abutment mechanism of the present invention is provided with:

an abutment member for abutting an abutted member over the longitudinal direction;

supporting means that supports the abutment member and is pivotally movable about a pivotal axis;

pressurizing means for pivotally moving the supporting means in the direction for the abutment member to pressurize the abutted member; and pivotal axis moving means capable of changing the position of the pivotal axis by a pressurizing operation by the pressurizing means.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS (First Embodiment)

Figure 1:
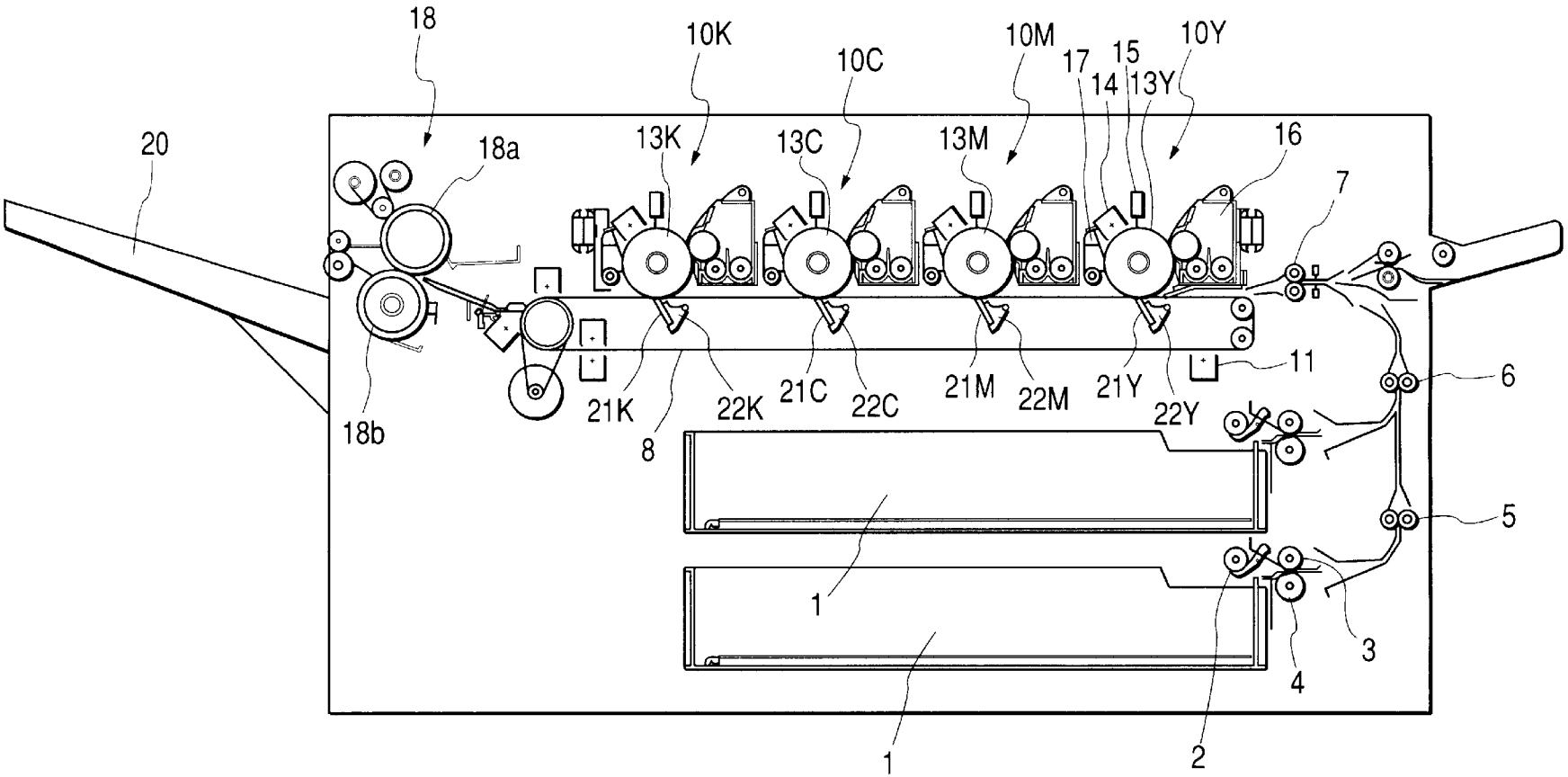
FIG. 1 illustrates an overall configuration of an image forming apparatus in accordance with a first embodiment of the present invention.
Figure 2:
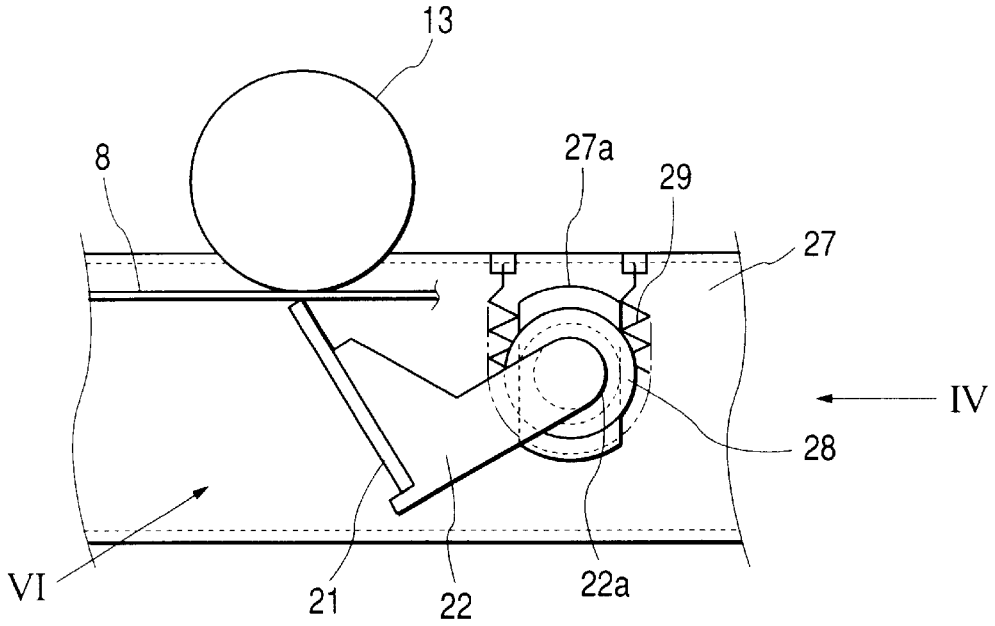
FIG. 2 is an enlarged sectional view of a transfer portion.
Figure 3:
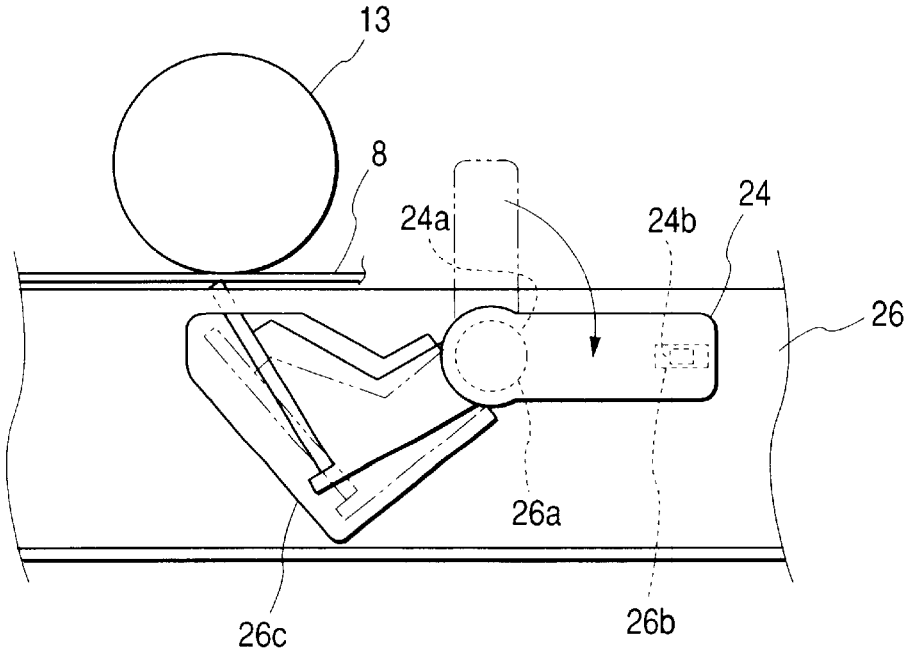
FIG. 3 is an enlarged front view of the transfer portion.
Figure 4A:
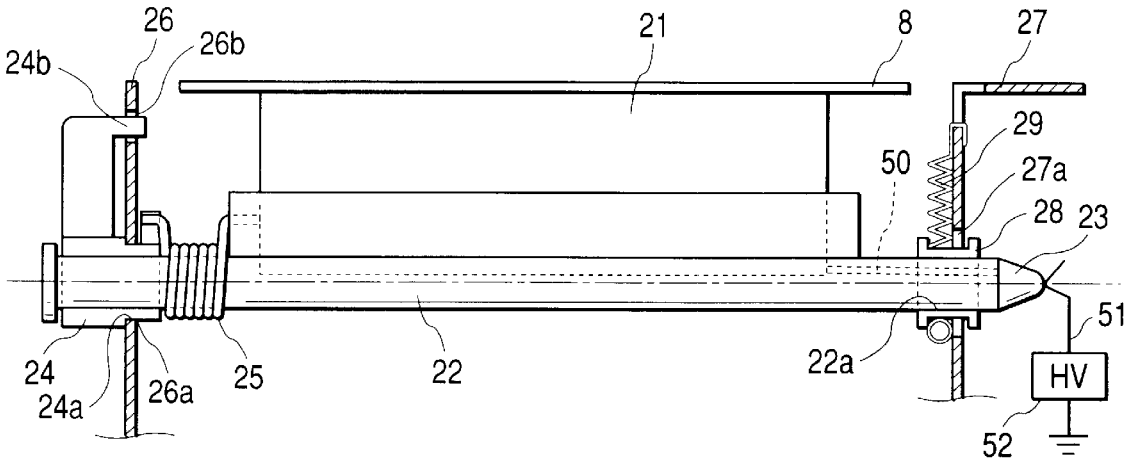
FIGS. 4A, 4B and 4C are longitudinal sectional views of the transfer portion.
Figure 4B:
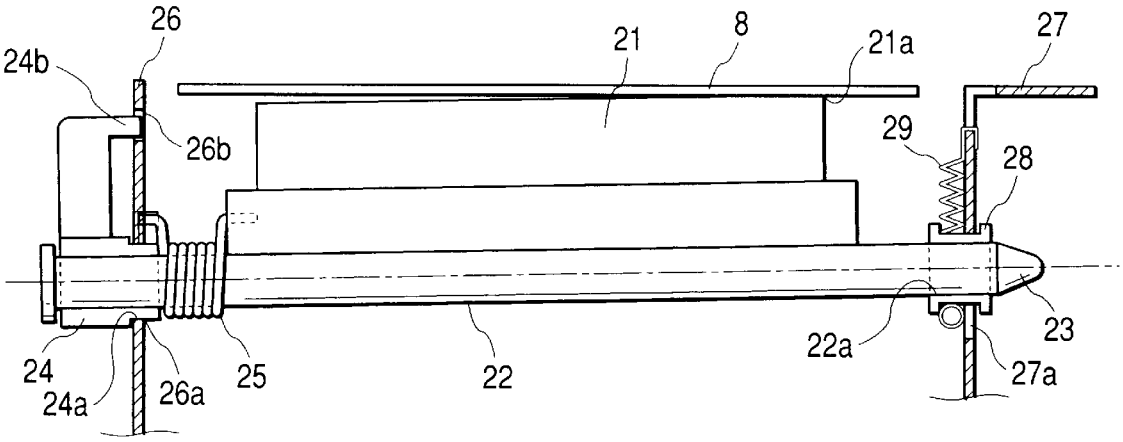
Figure 4C:
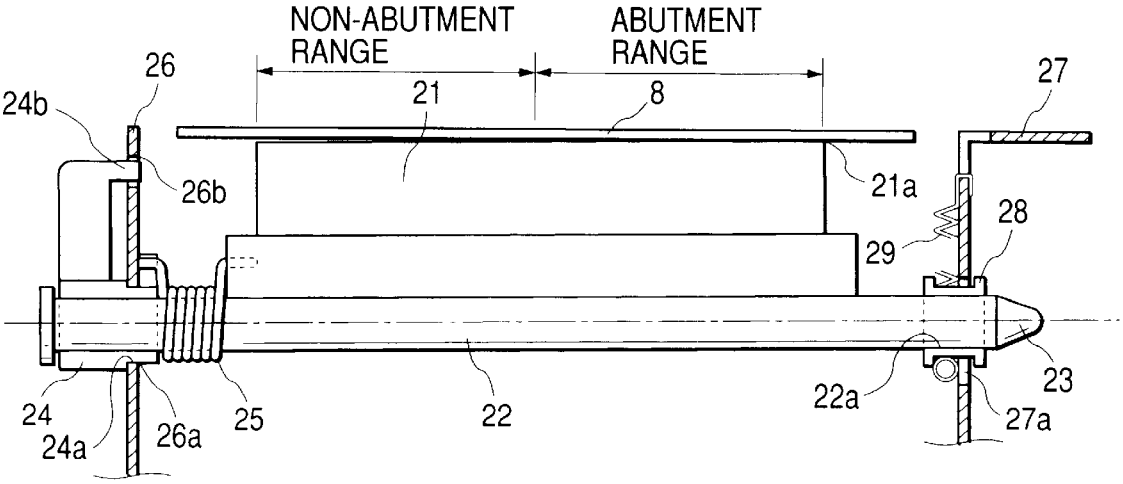

An embodiment of an image forming apparatus in accordance with the present invention will be described in accordance with the drawings. FIG. 1 illustrates an overall view of an image forming apparatus in accordance with an embodiment of the present invention. FIG. 2 is an enlarged sectional view of a transfer portion. FIG. 3 is an enlarged front view of the transfer portion. FIGS. 4A, 4B and 4C are longitudinal sectional views of the transfer portion viewed from the direction indicated by the arrow IV in FIG. 2.

(Overall Configuration)

The overall configuration of the image forming apparatus will be described first with reference to FIG. 1. The image forming apparatus shown in FIG. 1 is a color electrophotographic image forming apparatus for forming an image by superimposing toners of four colors, namely, magenta, cyan, yellow and black, and includes image forming portions 10Y, 10M, 10C and 10K for respective colors. These image forming portions 10 (10Y, 10M, 10C and 10K) are linearly arranged, against all of which a transfer belt 8 being transfer material bearing means as abutted members abuts.

A cassette 1 for stocking and containing recording sheets being transfer materials is disposed in the lower part of the apparatus. The cassette 1 forwards the recording sheets by a pick-up roller 2, separates the recording sheets one by one and feeds each recording sheet by a feed roller 3 and a retard roller 4, and conveys it to a pair of registration rollers 7 by conveying rollers 5 and 6. The recording sheet is corrected its skew feed by the pair of registration rollers 7, and then forwarded to the transfer belt 8 in register with an image forming operation.

The transfer belt 8 is formed of an insulating or dielectric resin sheet material, and its surface is charged by a charger 11 below the transfer belt 8. While it is charged, latent images corresponding to respective colors are formed on photosensitive drums 13C, 13M, 13Y and 13K by an image information signal sent from an output apparatus (not shown) such as an original reading apparatus or a computer. The recording sheet forwarded from the pair of registration rollers 7 are electrostatically attracted on the charged transfer belt 8, and conveyed through respective color image forming portions 10Y, 10M, 10C and 10K by the transfer belt 8.

In each of the image forming portions, a charger 14, an exposure LED head 15, a developing device 16 and a cleaner 17 are arranged around the photosensitive drum 13 as an image bearing member. A toner image of each color is formed on the surface of the photosensitive drum 13 by a known electrophotographic process. The images of respective colors are transferred on the recording sheet, which is electrostatically attracted and conveyed by the transfer belt 8, one after another by transfer blades 21Y, 21M, 21C and 21K being transfer means as abutment members, in the positions where the transfer belt 8 and the photosensitive drums 13 are adjacent each other.

The recording sheet on which transfer of toner images of four colors has been completed is stripped from the transfer belt 8 by self stripping (separation due to a curvature) and reaches a fixing device 18. The fixing device 18 is heated by a heating roller 18*a* having a heater (not shown) inside and is applied a pressure by a pressure roller 18*b*. Then, toner of each color is thermally fused and fixed on the recording sheet, and a color image completes. The recording sheet on which the image is fixed by the fixing device 18 is delivered on a delivery tray 20 that protrudes outside the apparatus.

(Transfer Portion)

The transfer portion will now be described in detail with reference to FIGS. 2, 3, 4A, 4B and 4C.

A transfer blade 21 being transferring means is composed of a plate-shaped member such as a rubber plate or a brush having conductivity, and is supported by a transfer blade holder 22.

The transfer blade 21 transfers a toner image on the photosensitive drum 13 onto a recording sheet by applying an electric field in a transfer process and forming a transfer electric field between the transfer blade 21 and the photosensitive drum 13. In order to apply the electric field, the transfer blade holder 22 has an electrode portion 23 (see FIGS. 4A to 4C) for supplying a high voltage in the back side of the transfer blade holder 22. The electrode portion 23 is electrically connected to a contact portion 51 and a power source 52 disposed in the back side deeper than a back side plate 27, and is also electrically connected to the transfer blade 21 via a conductive portion 50 inside the transfer blade holder 22. Moreover, the transfer blade holder 22 is formed of mold resin in order to prevent an electric leak to metal parts around it.

A pressurizing arm 24 is provided rotatably with respect to the transfer blade holder 22 in the front side of the transfer blade holder 22. Moreover, a torsion coil spring 25 being pressurizing means is provide between the transfer blade holder 22 and the pressurizing arm 24. The torsion coil spring 25 is twisted at a predetermined angle by rotating the pressurizing arm 24 in the direction indicated by an arrow in FIG. 3, and pressurizes the transfer blade 21 in the direction of the photosensitive drum 13. A predetermined amount of torsion angle is given to the torsion coil spring 25 by engaging a protruded portion 24*b* of the pressurizing arm 24 with a square hole portion 26*b* of the front side plate 26.

An opening portion 26*c* for integrally inserting and removing the transfer blade 21 and the transfer blade holder 22 is provided in the front side plate 26 being a frame of a transfer belt unit. The transfer blade 21 and the transfer blade holder 22 can be inserted and removed in the state shown by an alternate long and two short dashes line in FIG. 3. A circular portion 26*a* for rotatably supporting a boss portion 24*a* of the pressurizing arm 24 is formed in a part of this opening portion 26*c*.

A long hole 27*a* in substantially the longitudinal direction is provided in the back side plate 27 of the transfer belt unit. A back side end part of the transfer blade holder 22 is movably supported in the direction of the long hole via a slider 28 being a supporting member, and is also biased upward by a lifting spring 29 being biasing means. An internal diameter part of the slider 28 supports rotatably a back side boss portion 22*a* which is a rotational central shaft of the transfer blade holder 22 as well as a pivotal movement central shaft.

In this way, the boss portion 24*a* of the pressurizing arm 24 is pivotably supported by the circular portion 26*a* and the back side boss portion 22*a* fits into the slider 28. Thus, a rotational central axis in front or back of the transfer blade 21 and the transfer blade holder 22 is formed, and the transfer blade 21 and the transfer blade holder 22 are rotatably supported in the direction to be in contact and out of contact with the photosensitive drum 13. Then, as described later, a rotational central axis moving mechanism is formed by the slider 28, the long hole 27*a* and the lifting spring 29.

Since a transferring means takes the form in which it can be inserted and removed from the front of a transfer belt unit to improve its maintenance performance, it is often pressurized from one side in the front or the back side of a transfer blade holder. Moreover, since the transfer blade holder is formed of resin as described above, torsion occurs in the longitudinal direction. Thus, the side on which a pressurizing spring works is twisted largely and the torsion decreases toward the side on which the pressurizing spring does not work. In other words, an abutment pressure of the transfer blade is high in the side on which the pressurizing spring works and decreases toward the side on which the pressurizing spring does not work.

However, in the present invention, the back side on which the torsion coil spring 25 being pressurizing means does not work is formed such that it is movable by the long hole 27*a* and pressurized by the lifting spring 29. Therefore, pressurizing force does not concentrate on one end of the transfer blade holder 22, the torsion as described above is prevented and an abutment pressure can be applied substantially equally.

Operations for equalizing an abutment pressure by a rotational central axis moving mechanism will now be described with reference to FIGS. 4A to 4C. First, as shown in FIG. 4A, the pressurizing arm 24 is rotated and a protruded portion 24*b* is engaged in the square hole portion 26*b* of the front side plate 26, and the transfer blade 21 and the transfer blade holder 22 are thereby pivotally moved toward the photosensitive drum 13 and pressurized.

Since the back side boss portion 22*a* being a rotational center in the back side has already been biased upward by the lifting spring 29 as shown in FIG. 4B, a back side corner portion 21*a* of the transfer blade 21 abuts against the transfer belt 8 first. Further, dimensions of the long hole 27*a* of the back side plate 27 are determined such that it has a movement range larger than a maximum deviation amount from an ideal position considering the fluctuation of tolerance of various parts. More specifically, it is desirable to give an allowance in the order of ±0.5 to ±2 mm above and below the ideal position. The pressurizing arm 24 starts rotation from this state.

When an abutment pressure of the back side corner portion 21*a* rises with the addition of a pressurizing force due to the rotation of the pressurizing arm, a force for lowering the back side boss portion 22*a* works by its reaction. When this reaction is stronger than a biasing force of the lifting spring 29, the slider 28 and the back side boss portion 22*a* starts moving downward against the biasing force of the lifting spring 29. That is, the back side rotational center moves downward.

The transfer blade 21 and the transfer blade holder 22 are rotated by the downward movement of this back side rotational center, and an abutment area of the transfer blade 21 and the transfer belt 8 expands in the forward direction as shown in FIG. 4C. When the abutment area expands, the reaction for lowering the back side rotational center downward is reduced and its movement decreases.

Then, when the entire area of the transfer blade 21 abuts against the transfer belt 8, the movement of the back side rotational center stops. That is, the movement of the back side rotational center stops in a position where the pressurizing force of the torsion coil spring 25 and the pressurizing force of the lifting spring 29 balance. At this point, the abutment pressure is substantially equal or uniform in the entire area in the longitudinal direction of the transfer blade 21. Thus, the bent of the transfer blade 21 also becomes equal or uniform and a positional deviation of the transfer blade 21 with respect to the photosensitive drum 13 is small.

Here, the pressurizing force of the lifting spring 29 is preferably an amount substantially one half of the sum of the abutment forces generated by the torsion coil spring 25 and the lifting spring 29 plus a sliding resistance generated by the slider 28 on moving in the long hole 27*a*. For example, if the sum of the abutment forces is 0.1N, it is preferable to set the value of the lifting spring 29 within the order of 0.05 to 0.07N.

(Second Embodiment)

Figure 5:
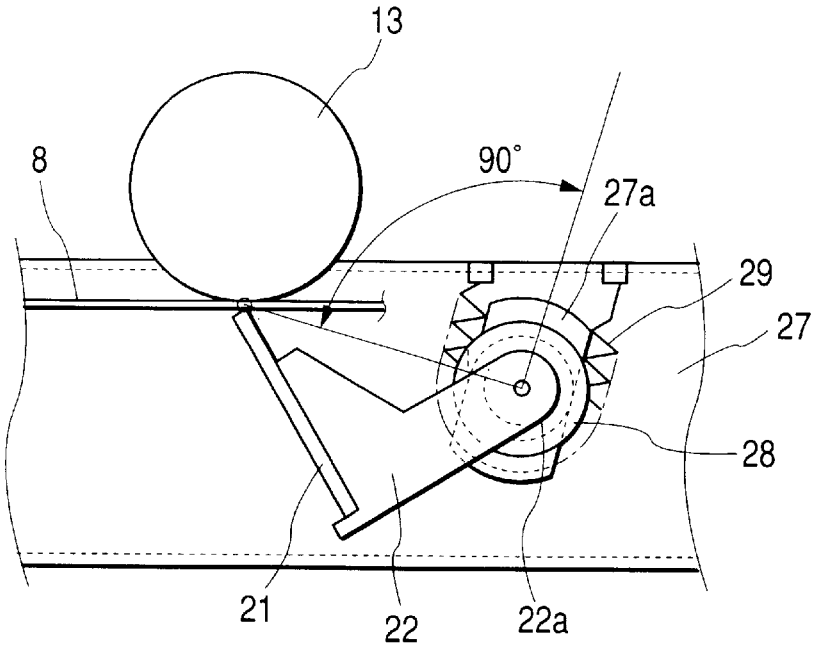
FIG. 5 is an enlarged sectional view of a transfer portion in accordance with a second embodiment of the present invention.

A second embodiment of the image forming apparatus in accordance with the present invention will be described. FIG. 5 is an enlarged sectional view of a transfer portion in accordance with this embodiment. The parts identical with those in the first embodiment are designated by the identical reference numerals and, descriptions on such parts are omitted.

The direction of the long hole 27*a* is described as the vertical direction in the above-mentioned first embodiment. In this embodiment, the direction of the long hole 27*a* is the direction substantially perpendicular to a line connecting the contact point of the transfer blade 21, the photosensitive drum 13 and the transfer belt 8 and the rotational center of the transfer blade 21 as shown in FIG. 5.

This reduces a resistance of the slider 28 moving along the long hole 27*a,* and a smooth equalizing operation can be performed. In addition, a deviation of a transfer blade contacting portion in accordance with the movement of the rational center can be reduced.

(Third Embodiment)

Figure 6:
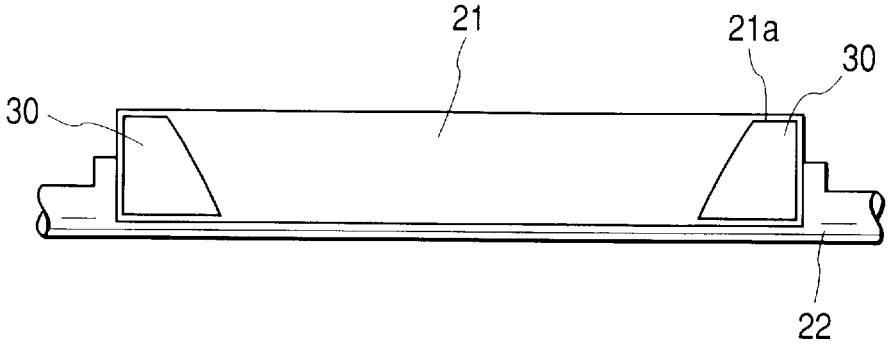
FIG. 6 is a longitudinal sectional view of a transfer portion in accordance with a third embodiment of the present invention.

A third embodiment of the image forming apparatus in accordance with the present invention will be described. FIG. 6 is a longitudinal sectional view of a transfer portion in accordance with this embodiment. The parts identical with those in each of the above-mentioned embodiments are designated by the identical reference numerals and, descriptions on such parts are omitted.

In this embodiment, a case in which the transfer blade 21 is made of a material with small flexural rigidity will be described. When the back side corner portion 21*a* of the transfer blade 21 abuts against the transfer belt 8 in the above-mentioned operation, if the transfer blade 21 is formed of a material with small flexural rigidity, it is likely that the back side corner portion 21*a* largely bends locally and a downward movement of the back side rotational position is insufficient. In addition, the same tendency is observed in a case in which a friction between the transfer blade 21 and the transfer belt 8 is relatively large.

In such a case, it is preferable to make flexural rigidity of the end part of the transfer blade 21 larger compared with the central part. More specifically, as shown in FIG. 6 (a longitudinal view of the transfer portion viewed from the direction indicated by the arrow VI in FIG. 2), such an effect can be realized by attaching a back-up sheet 30 on an end part of a surface of the transfer belt 21 opposite a surface abutting against the transfer belt 8. In addition, the effect may be realized by attaching the back-up sheet 30 on the entire width of the transfer blade 21 and overlapping the sheet on the end part.

(Fourth Embodiment)

Figure 7:
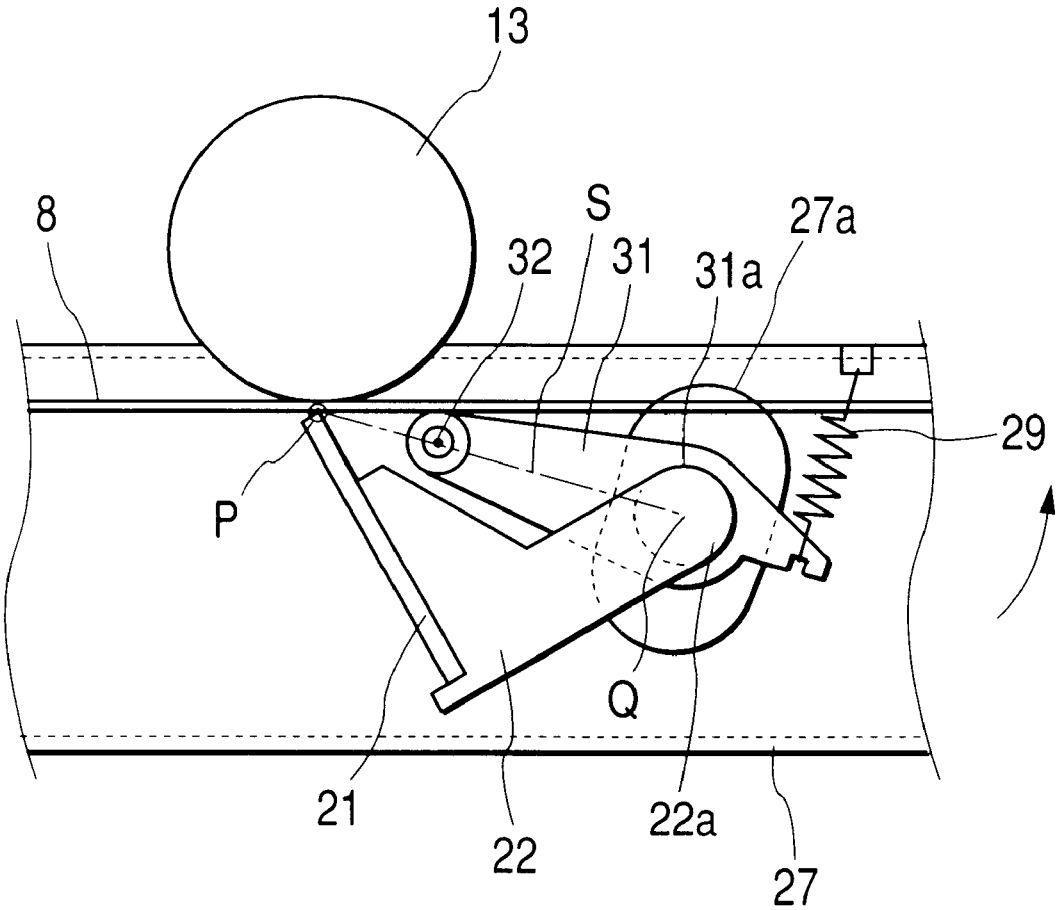
FIG. 7 is an enlarged sectional view of a transfer portion in accordance with a fourth embodiment of the present invention.
Figure 8A:
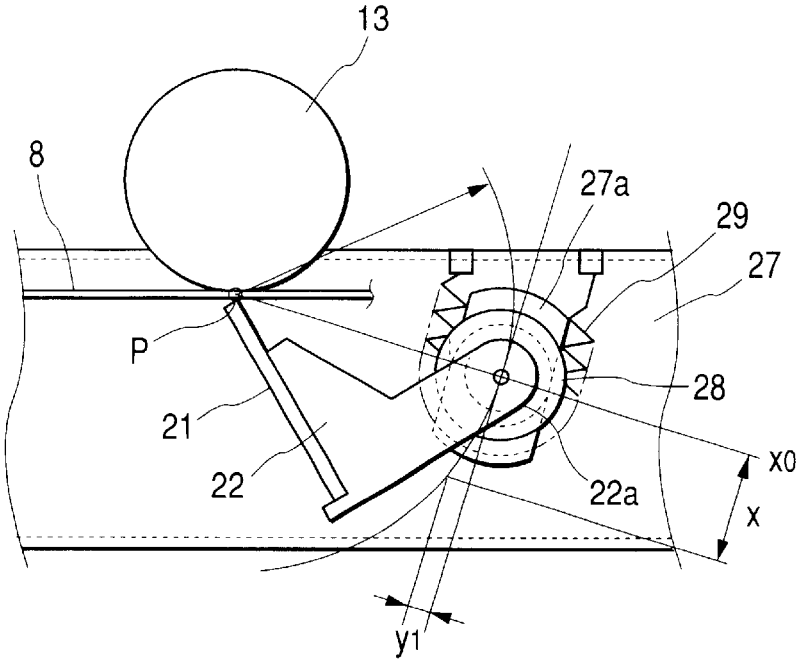
FIGS. 8A and 8B are views explaining a deviation amount of a transfer blade.
Figure 8B:
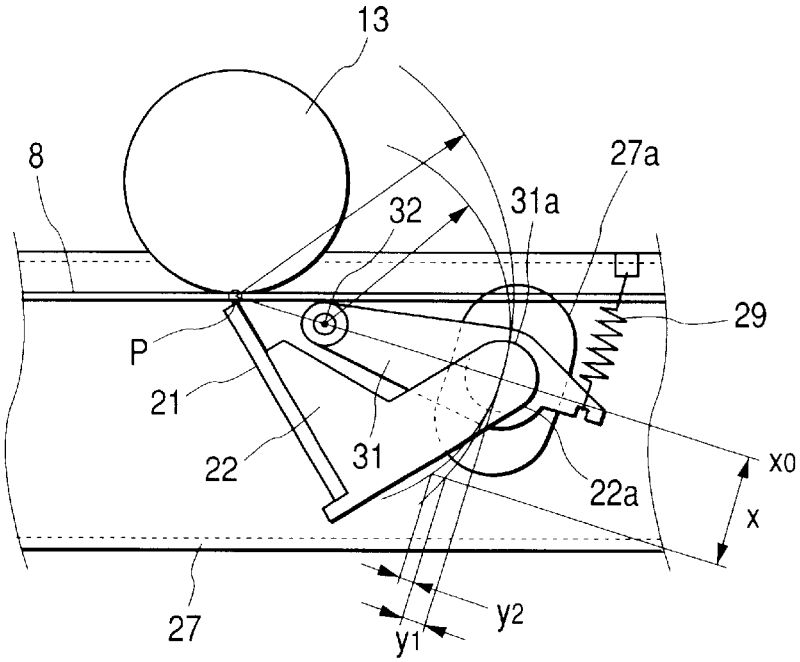

A fourth embodiment of the image forming apparatus in accordance with the present invention will be described. FIG. 7 is an enlarged sectional view of a transfer portion in accordance with this embodiment. FIGS. 8A and 8B are views explaining a deviation amount of a transfer blade contacting portion. The parts identical with those in each of the above-mentioned embodiments are designated by the identical reference numerals and, descriptions on such parts are omitted.

The long hole 27*a* for moving the back side rotational center of the transfer blade holder 22 is described as linearly configured. However, as described above, if the back side corner portion 21*a* of the transfer blade 21 moves downward by a reaction force, the transfer blade holder 22 tends to rotate around a contact part P of the transfer blade 21 and the transfer belt 8. Therefore, a deviation amount of the contact part P compared with a deviation amount of the back side rotational center is a difference between a trajectory of movement of the back side rotational center and a trajectory of an arc of the back side rotational center around the contact part P.

For example, in the configuration shown in the second embodiment, the back side rotational center moves along the long hole 27*a* as shown in FIG. 8A. Thus, if the back side rotational center moves from an ideal position x0 by a deviation amount x, the distance between the contact part P and the back side rotational center changes, and the contact part P deviates by an deviation amount y1.

Therefore, in this embodiment, a rotational center holder 31 is pivotally supported around a pivotal movement center 32 on the back side plate 27 and is biased upward by the lifting spring 29 as shown in FIG. 7. The back side boss portion 22*a* of the transfer blade holder 22 is positioned by a fitting hole 31*a* of the rotational center holder 31 and is rotatably supported. A supporting method in the front side of the transfer blade holder 22 and a pressurizing method by the torsion coil spring 25 are the same as those in the above-mentioned first embodiment.

With such a configuration, since the back side rotational center rotates around the pivotal movement center 32 by the rotational center holder 31 as shown in FIG. 8B, the trajectory of the back side rotational center is an arc around the pivotal movement center 32. Therefore, a deviation amount y2 of the contact part P compared with a deviation amount x of the back side rotational center is a difference of trajectories of both the arcs. Thus, the deviation amount y2 can be smaller than the deviation amount y1 in the configuration of the second embodiment.

Further, it is preferable to make the pivotal movement center 32 to coincide with the contact part P because the trajectories of the above-mentioned both arcs can coincide and the deviation amount y2 can be close to 0. Moreover, it is preferable to position the pivotal movement center 32 of the rotational center holder 31 in the vicinity of a straight line S connecting the contact part P and a rotational center axis Q of the transfer blade holder 22, more preferably on the line S.

In addition, since the back side rotational center is pivotally supported, a pivotal movement resistance becomes weaker and more smooth equalizing operations is possible.

Therefore, a moment in the direction to rotate the rotational center holder 31 can be smaller when the transfer belt 8 moves, the back side rotational center can be easily moved upward or downward in an operational state, and inequality of abutment pressures, an occurrence of a deviation of the contact part P, or the like can be prevented.

(Fifth Embodiment)

Figure 9:
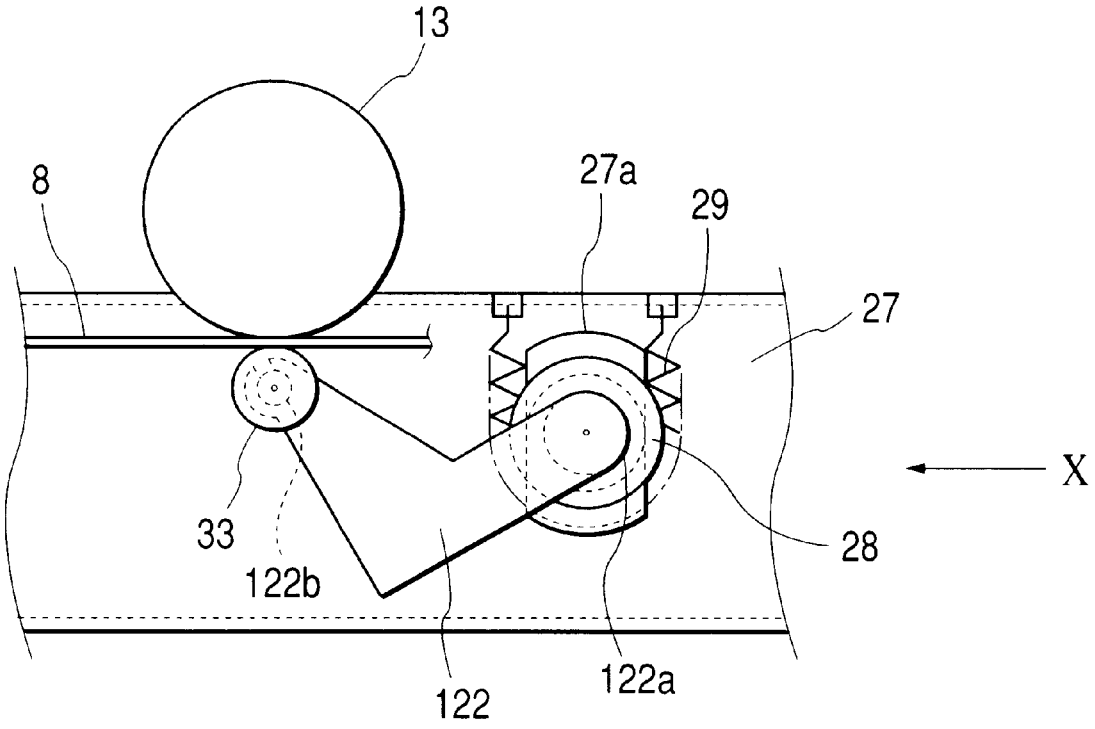
FIG. 9 is an enlarged sectional view of a transfer portion in accordance with a fifth embodiment of the present invention.
Figure 10:
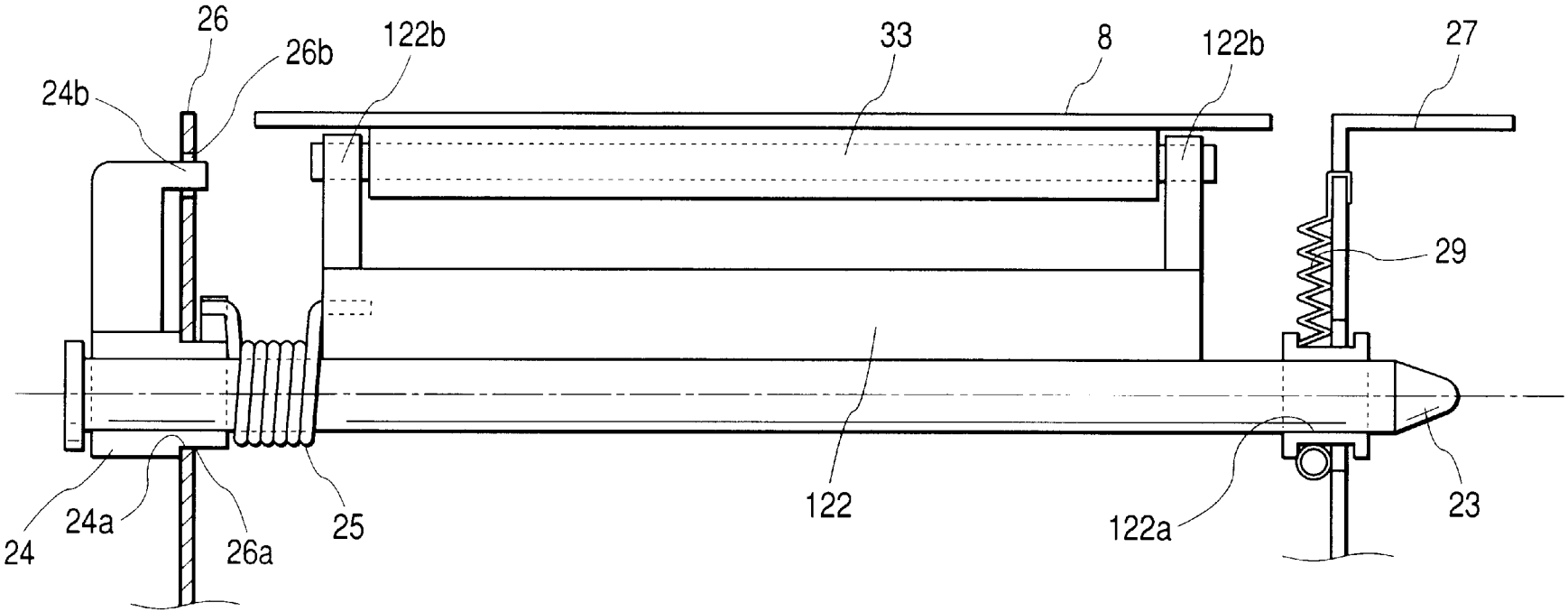
FIG. 10 is a longitudinal sectional view of the transfer portion in accordance with the fifth embodiment of the present invention.

A fifth embodiment of the image forming apparatus in accordance with the present invention will be described. FIG. 9 is an enlarged sectional view of the transfer portion in accordance with this embodiment. FIG. 10 is a longitudinal sectional view of the transfer portion, which is viewed from the direction indecated by the arrow X in FIG. 9. The parts identical with those in each of the above-mentioned embodiments are designated by the identical reference numerals and, descriptions on such parts are omitted.

Although transferring means is described as using the transfer blade 21 being a plate-shaped member in each of the above-mentioned embodiments, the present invention is not limited to this and roller means may be used.

In the configuration shown in FIG. 9, a supporting portion 122*b* of an arc shape is formed in both end parts immediately below the transfer belt 8 of a transfer roller holder 122 and rotatably supports a transfer roller 33. The transfer roller 33 is made of EPDM foaming rubber of a predetermined volume resistivity formed in a roller shape around a metal shaft.

The transfer roller 33 is rotated by the movement of the transfer belt 8 when the transfer roller 33 is pressed against the transfer belt 8 as shown in FIG. 10. In addition, the transfer roller 33 is configured such that the transfer roller 33 is electrically connected to an electrode portion 23 and a high voltage for transfer is applied to the transfer roller 33. Besides, a supported configuration on a transfer unit, a direction of pressurization and an equalizing operation are the same as those in the above-mentioned embodiments.

With such a configuration, equalization of transfer pressures in a transfer roller system can be realized, and attachability/detachability of the parts including the transfer roller holder 122 can be improved.

Further, the rotational center moving mechanism in the transfer roller 33 is not limited to this embodiment, and any configuration of the above-mentioned second, third and fourth embodiments can be applied.

(Other Embodiments)

In the above-mentioned embodiments, a transfer portion of an image forming apparatus is described which has a plurality of process units and adopts a method of transferring images one after another on a sheet material on a transfer material bearing member (a plural drum method). However, it is needless to mention that the present invention is not limited to this and is also effective in an image forming apparatus having one process unit. Moreover, the present invention may be employed in a transfer portion of an image forming apparatus of a method with which a transfer material bearing member is made to oppose one image bearing member to which a plurality of developing devices are opposite and to pass through an identical transfer position for a plurality of times for respective colors to form an image (a one drum method).

Figure 11:
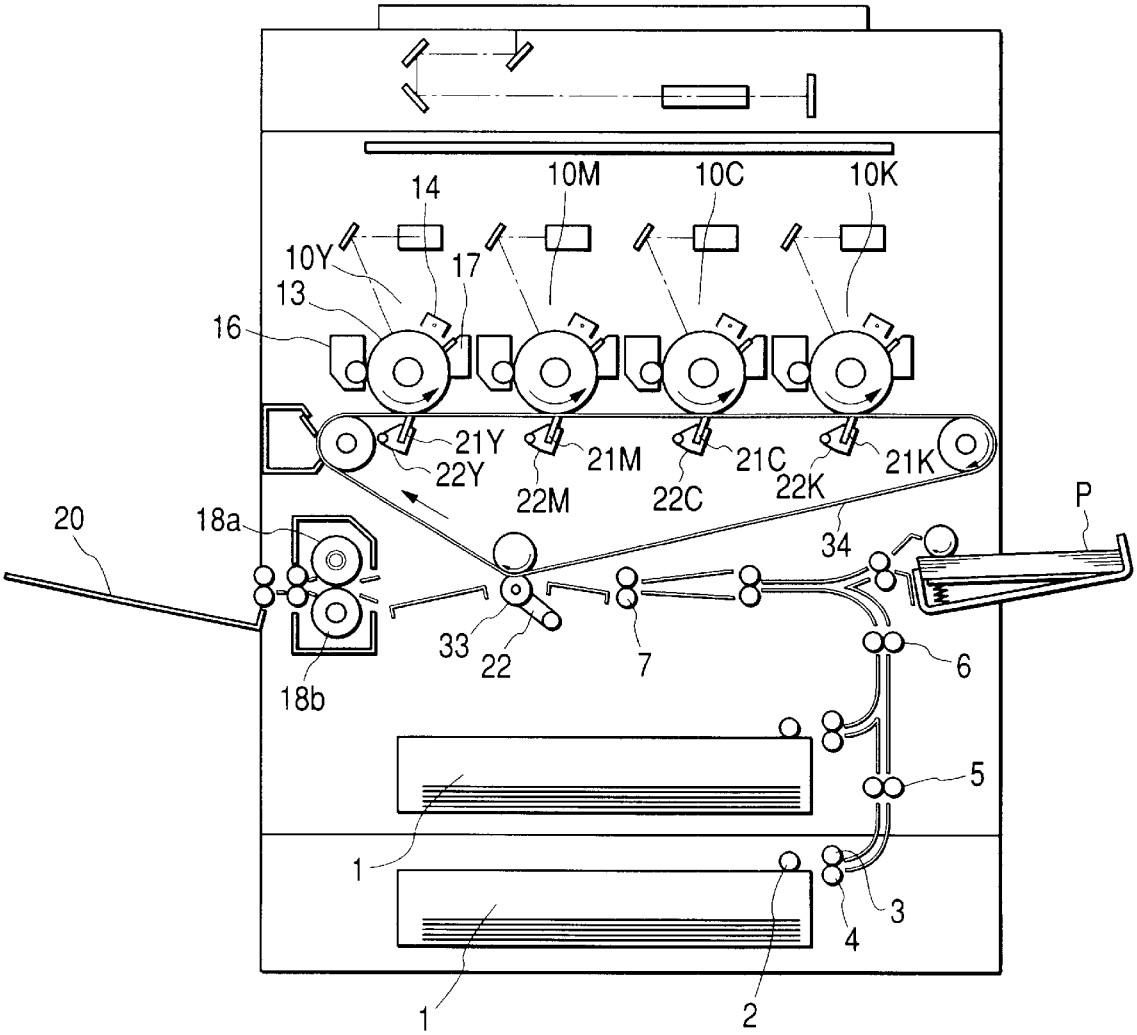
FIG. 11 illustrates an overall configuration of an image forming apparatus in accordance with another embodiment of the present invention.
Figure 12:
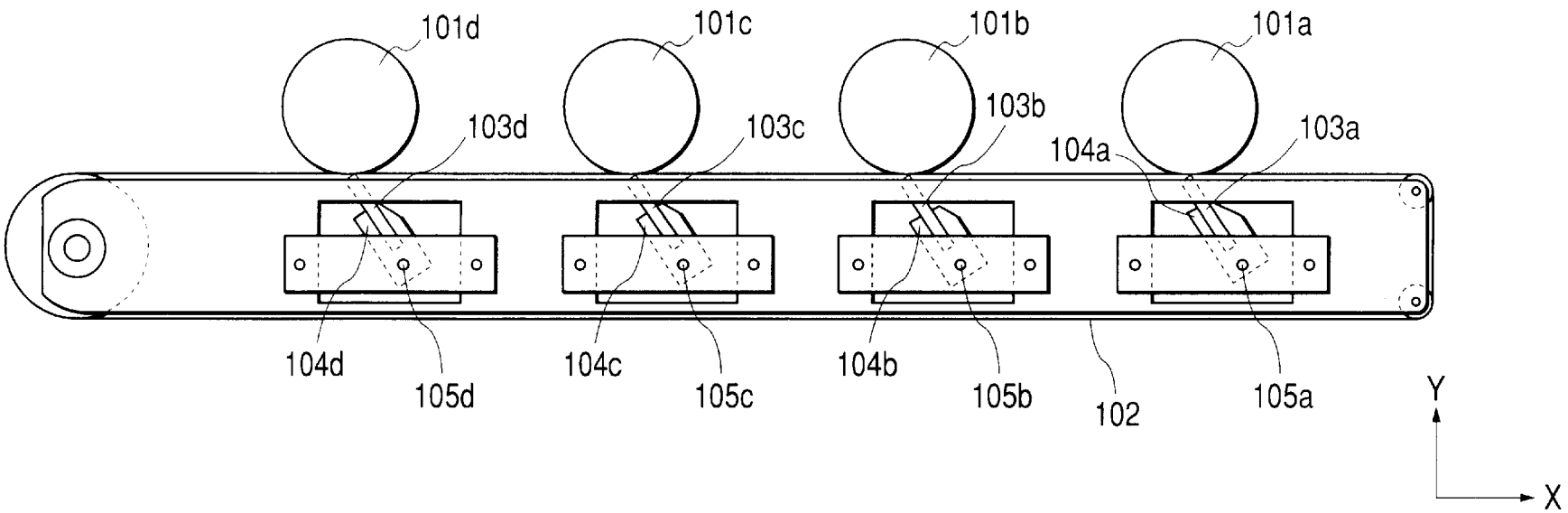
FIG. 12 is a view explaining a conventional image forming apparatus.

Moreover, the present invention may be employed in primary transfer portions and a secondary transfer portion of an image forming apparatus of a method with which an intermediate transfer member for temporarily bearing a toner image is made to oppose a plurality of process units, the toner image is primarily transferred to the intermediate transfer member in each primary transfer portion, and the toner image in which a plurality of color layers are superimposed is collectively transferred on a transfer material in the secondary transfer portion (an intermediate transfer method). For example, in an image forming apparatus shown in FIG. 11, the transfer blades 21Y, 21M, 21C and 21K are provided in the primary transfer portions for causing an intermediate transfer member 34 being abutted member to abut against the four image forming portions 10Y, 10M, 10*c* and 10K to superimpose and primarily transfer toner images. The configuration of the present invention described in the above-mentioned embodiments is used for supporting these transfer blades.

It is needless to mention that the present invention is effective either in this embodiment or in a configuration of an intermediate transfer member using one process unit.

In addition, although the transfer members have been described above, the present invention may be applied to a charging device for charging a member to be charged by using a charging member that contacts the member to be charged over the longitudinal direction while pivotally moving. For example, the present invention may be applied to support of a charging roller, a charging blade or the like for abutting against an image bearing member to induce a charge in the image bearing member.

As described above, in the image forming apparatus in accordance with the present invention, an abutment member can be pressed against an abutted member with a substantially equal or uniform abutment pressure, and an abutment positional deviation can be decreased by equalized deformation of the abutment member. Thus, lifetime of the abutted member, the abutment member or the like can be extended while restraining increase of costs for parts, production costs or the like. For example, if this is used in transferring means of an image forming apparatus, a high image quality can be realized without an image defect such as a blank area in a wide variety of sheets. In addition, if it is used in charging means, equal charging can be realized and an image of high quality can be obtained.

As many apparently widely different embodiments of the present invention can be made without departing from the spirit and scope thereof, it is to be understood that the invention is not limited to the specific embodiments thereof except as defined in the appended claims.

What is claimed is:

1. A pivotally movable abutment mechanism, comprising:

an abutment member for abutting against a member to be abutted over a longitudinal direction;

supporting means that supports said abutment member and is pivotally movable about a pivotal axis;

pressing means for pivotally moving said supporting means in a direction in which said abutment member is pressed against said member to be abutted; and pivotal axis moving means for changing a position of said pivotal axis by a pressing operation by said pressing means.

2. A pivotally movable abutment mechanism according to claim 1, wherein said pivotal axis moving means comprises:

holding means for holding said pivotal axis so that said pivotal axis is rotatable and movable in both directions to approach and recede from said member to be abutted; and biasing means for biasing said pivotal axis in the direction to approach said member to be abutted.

3. A pivotally movable abutment mechanism according to claim 2, wherein said holding means comprises:

a holding member for holding said pivotal axis rotatably; and a long hole for holding said holding member movably.

4. A pivotally movable abutment mechanism according to claim 3, wherein said long hole is elongated in a direction substantially perpendicular to a straight line connecting a contact portion between said member to be abutted and said abutment member and a pivotal center of said pivotal axis.

5. A pivotally movable abutment mechanism according to claim 2, wherein said holding means is pivotally movable about a rotational axis.

6. A pivotally movable abutment mechanism according to claim 5, wherein said rotational axis is arranged in the vicinity of a straight line connecting a contact portion between said member to be abutted and said abutment member and a pivotal center of said pivotal axis.

7. A pivotally movable abutment mechanism according to any one of claims 1 to 6, wherein said abutment member is one of a plate-shaped member and a brush-shaped member.

8. A pivotally movable abutment mechanism according to claim 7, wherein a flexural rigidity of an end portion of said abutment member is larger than a flexural rigidity of a central portion in the longitudinal direction of said abutment member.

9. A pivotally movable abutment mechanism according to any one of claims 1 to 6, wherein said abutment member is a roller member, and the roller member is rotatably supported by said supporting means.

10. A pivotally movable abutment mechanism according to any one of claims 1 to 6, wherein said pressing means is disposed on one end side of said pivotal axis, and said pivotal axis moving means is disposed on the other end side of said pivotal axis.

11. An image forming apparatus, including image forming means for forming an image on an image bearing member, a recording material bearing member for bearing and conveying a recording material, and a transfer member for abutting against a surface on an opposite side of a surface opposing said image bearing member of said recording material bearing member, wherein said image forming apparatus transfers an image on said image bearing member onto said recording material, which is born and conveyed by said recording material bearing member, by a transfer electric field induced by said transfer member, said image forming apparatus comprising:

supporting means that supports said transfer member and is pivotally movable about a pivotal axis;

pressing means for pivotally moving said supporting means in a direction in which said transfer member is pressed against said recording material bearing member; and pivotal axis moving means for changing a position of said pivotal axis by a pressing operation by said pressing means.

12. An image forming apparatus according to claim 11, wherein said pivotal axis moving means comprises:

holding means for holding said pivotal axis so that said pivotal axis is rotatable and movable in both directions to approach and recede from said recording material bearing member; and biasing means for biasing said pivotal axis in the direction to approach said recording material bearing member.

13. An image forming apparatus according to claim 12, wherein said holding means comprises:

a holding member for holding said pivotal axis rotatably; and a long hole for holding said holding member movably.

14. An image forming apparatus according to claim 13, wherein said long hole is elongated in a direction substantially perpendicular to a straight line connecting a contact portion between said recording material bearing member and said transfer member and a pivotal center of said pivotal axis.

15. An image forming apparatus according to claim 12, wherein said holding means is pivotally movable about a rotational axis.

16. An image forming apparatus according to claim 15, wherein said rotational axis is arranged in the vicinity of a straight line connecting a contact portion between said recording material bearing member and said transfer member and a pivotal center of said pivotal axis.

17. An image forming apparatus according to any one of claims 11 to 16, wherein said transfer member is one of a plate-shaped member and a brush-shaped member.

18. An image forming apparatus according to claim 17, wherein a flexural rigidity of an end portion of said transfer member is larger than a flexural rigidity of a central portion in a longitudinal direction of said transfer member.

19. An image forming apparatus according to any one of claims 11 to 16, wherein said transfer member is a roller member, and the roller member is rotatably supported by said supporting means.

20. An image forming apparatus according to any one of claims 11 to 16, wherein said pressing means is disposed on one end side of said pivotal axis, and said pivotal axis moving means is disposed on the other end side of said pivotal axis.

21. An image forming apparatus according to any one of claims 11 to 16, wherein said image bearing member and said transfer member are disposed in plurality in a conveying direction of said recording material, and images on said plurality of image bearing members are superimposed one after another on said recording material.

22. An image forming apparatus, including image forming means for forming an image on an image bearing member, and a transfer member for abutting against a surface on an opposite side of a surface opposing said image bearing member on an intermediate transfer member, wherein said image forming apparatus transfers an image on said image bearing member onto said intermediate transfer member by a transfer electric field induced by said transfer member, said image forming apparatus comprising:

supporting means that supports said transfer member and is pivotally movable about a pivotal axis;

pressing means for pivotally moving said supporting means in a direction in which said transfer member is pressed against said intermediate transfer member; and pivotal axis moving means for changing a position of said pivotal axis by a pressing operation by said pressing means.

23. An image forming apparatus according to claim 22, wherein said pivotal axis moving means comprises:

holding means for holding said pivotal axis so that said pivotal axis is rotatable and movable in both directions to approach and recede from said intermediate transfer member; and biasing means for biasing said pivotal axis in the direction to approach said intermediate transfer member.

24. An image forming apparatus according to claim 23, wherein said holding means comprises:

a holding member for holding said pivotal axis rotatably; and a long hole for holding said holding member movably.

25. An image forming apparatus according to claim 24, wherein said long hole is elongated in a direction substantially perpendicular to a straight line connecting a contact portion between said intermediate transfer member and said transfer member and a pivotal center of said pivotal axis.

26. An image forming apparatus according to claim 23, wherein said holding means is pivotally movable about a rotational axis.

27. An image forming apparatus according to claim 26, wherein said rotational axis is arranged in the vicinity of a straight line connecting a contact portion between said intermediate transfer member and said transfer member and a pivotal center of said pivotal axis.

28. An image forming apparatus according to any one of claims 22 to 27, wherein said transfer member is one of a plate-shaped member and a brush-shaped member.

29. An image forming apparatus according to claim 28, wherein a flexural rigidity of an end portion of said transfer member is larger than a flexural rigidity of a central portion in a longitudinal direction of said transfer member.

30. An image forming apparatus according to any one of claims 22 to 27, wherein said transfer member is a roller member, and the roller member is rotatably supported by said supporting means.

31. An image forming apparatus according to any one of claims 22 to 27, wherein said pressing means is disposed on one end side of said pivotal axis, and said pivotal axis moving means is disposed on the other end side of said pivotal axis.

32. An image forming apparatus according to any one of claims 22 to 27, wherein said image bearing member and said transfer member are disposed in plurality in a moving direction of said intermediate transfer member, and images on said plurality of image bearing members are superimposed one after another on said intermediate transfer member.

33. A charging device, comprising:

an abutment member for abutting against a member to be charged over a longitudinal direction;

charge inducing means for inducing a charge in said member to be charged via said abutment member;

supporting means that supports said abutment member and is pivotally movable about a pivotal axis;

pressing means for pivotally moving said supporting means in a direction in which said abutment member is pressed against said member to be charged; and pivotal axis moving means for changing a position of said pivotal axis by a pressing operation by said pressing means.

34. A charging device according to claim 33, wherein said pivotal axis moving means comprises:

holding means for holding said pivotal axis so that said pivotal axis is rotatable and movable in both directions to approach and recede from said member to be charged; and biasing means for biasing said pivotal axis in the direction to approach said charged member to be charged.

35. A charging device according to claim 34, wherein said holding means comprises:

a holding member for holding said pivotal axis rotatably; and a long hole for holding said holding member movably.

36. A charging device according to claim 35, wherein said long hole is elongated in a direction substantially perpendicular to a straight line connecting a contact portion between said member to be charged and said abutment member and a pivotal center of said pivotal axis.

37. A charging device according to claim 34, wherein said holding means is pivotally movable about a rotational axis.

38. A charging device according to claim 37, wherein said rotational axis is arranged in the vicinity of a straight line connecting a contact portion between said member to be charged and said abutment member and a pivotal center of said pivotal axis.

39. A charging device according to any one of claims 33 to 38, wherein said abutment member is one of a plate-shaped member and a brush-shaped member.

40. A charging device according to claim 39, wherein a flexural rigidity of an end portion of said abutment member is larger than a flexural rigidity of a central portion in a longitudinal direction of said abutment member.

41. A charging device according to any one of claims 33 to 38, wherein said abutment member is a roller member, and the roller member is rotatably supported by said supporting means.

42. A charging device according to any one of claims 33 to 38, wherein said pressing means is disposed on one end side of said pivotal axis, and said pivotal axis moving means is disposed on the other end side of said pivotal axis.

* * * * *

UNITED STATES PATENT AND TRADEMARK OFFICE

CERTIFICATE OF CORRECTION

PATENT NO. : 6,496,679 B2
DATED : December 17, 2002
INVENTOR(S) : Makoto Kitahara It is certified that error appears in the above-identified patent and that said Letters Patent is hereby corrected as shown below:

Column 1,
Line 65, “bent” should read -- bend --.

Column 3,
Line 4, “positions” should read -- position --.
Line 31, “an” should read -- a --.

Column 5,
Line 7, “adjacent” should read -- adjacent to --.
Line 43, “provide” should read -- provided --.

Column 8,
Line 67, “is” should read -- are --.

Column 9,
Line 13, “indecated” should read -- indicated --.

Signed and Sealed this

First Day of July, 2003

JAMES E. ROGAN
*Director of the United States Patent and Trademark Office*